US006000935A

United States Patent [19]

Regimand et al.

[11] Patent Number: 6,000,935

[45] Date of Patent: Dec. 14, 1999

[54] ADJUSTABLE APPARATUS FOR PYROLYSIS OF A COMPOSITE MATERIAL AND METHOD OF CALIBRATION THEREFOR

[75] Inventors: Ali Regimand; Lawrence H. James, both of Raleigh; Lawrence E. Peters; John T. Eagan, Jr., both of Cary, all of N.C.

[73] Assignee: Troxler Electronic Laboratories, Inc, Research Triangle Park, N.C.

[21] Appl. No.: 08/803,571

[22] Filed: Feb. 21, 1997

[51] Int. Cl.[6] ..... F23J 1/00

[52] U.S. Cl. ..... 432/72; 110/214

[58] Field of Search ..... 432/72, 120; 110/203, 110/205, 210, 211, 214

[56] References Cited

U.S. PATENT DOCUMENTS

| | | | |
|---|---|---|---|
| Re. 33,077 | 10/1989 | Van Dewoestine | 110/203 |
| Re. 34,373 | 9/1993 | Collins et al. | 219/10.55 |
| 451,961 | 5/1891 | Trowbridge . | |
| 773,920 | 11/1904 | Boulger . | |
| 1,070,209 | 8/1913 | Thorpe et al. . | |
| 2,855,494 | 10/1958 | Kuebler . | |
| 2,962,987 | 12/1960 | Hebert et al. . | |
| 3,055,206 | 9/1962 | Watson et al. . | |
| 3,068,812 | 12/1962 | Hemeon . | |
| 3,139,726 | 7/1964 | Wilson et al. . | |
| 3,150,619 | 9/1964 | Brucken et al. . | |
| 3,292,417 | 12/1966 | Hayden et al. . | |
| 3,353,508 | 11/1967 | Crowe . | |
| 3,485,190 | 12/1969 | Pelletier . | |
| 3,496,890 | 2/1970 | La Rue . | |
| 3,509,834 | 5/1970 | Rosenberg et al. . | |
| 3,509,835 | 5/1970 | Dibelius et al. . | |
| 3,557,725 | 1/1971 | Stookey | 110/10 |
| 3,602,161 | 8/1971 | Wyrough | 110/7 |
| 3,613,607 | 10/1971 | Hacker | 110/18 |
| 3,671,195 | 6/1972 | Bersin | 23/230 |
| 3,716,967 | 2/1973 | Doyle, Jr. et al. | 55/217 |

(List continued on next page.)

FOREIGN PATENT DOCUMENTS

| | | | |
|---|---|---|---|
| 31 12976 A1 | 1/1983 | European Pat. Off. | F23B 5/04 |
| 0 185 931 A3 | 7/1986 | European Pat. Off. | F23G 5/10 |
| 43 35 667 A1 | 10/1994 | European Pat. Off. | G01N 33/42 |
| 0 717 250 A1 | 6/1996 | European Pat. Off. | F27B 17/00 |
| 653513 | 5/1951 | Italy | 97/143 |
| 702578 | 1/1954 | United Kingdom | 97/143 |
| WO 94/23279 | 10/1994 | WIPO | G01N 5/04 |

OTHER PUBLICATIONS

Dialog search results of DE 19506358 A and DE 4335667 A.

Print of World Wide Web page—VWR Scientific Products On–Line Catalog; Programmable Ashing Furnaces, Type 6000, Thermolyne.

Todres and Bhattacharja, Solvent–Free, Nuclear–Free Determination of Asphalt Content and Gradation of Hot–Mix Asphalt Concrete; *The American Society for Testing and Materials* (Nov. 1994), pp. 568–574.

Brown, et al, *Historical Development of Asphalt Content Determination by the Ignition Method*, pp. 241–277.

(List continued on next page.)

*Primary Examiner*—Ronald Capossela
*Attorney, Agent, or Firm*—Bell Seltzer, Intellectual Property Law Group of Alston & Bird LLP

[57] ABSTRACT

An apparatus for pyrolysis of a sample of a composite material containing a combustible binder includes a combustion chamber configured to receive a sample of the composite material and having an outlet. A heater is associated with the combustion chamber for heating the chamber to a temperature sufficient for pyrolysis of the binder. A blower is in fluid communication with the combustion chamber for creating an airflow through the outlet to remove airborne pyrolysis products from the combustion chamber. An adjustable airflow regulator is operable to adjustably control the airflow to provide a desired minimum residence time within the combustion chamber sufficient for complete pyrolysis of the airborne pyrolysis byproducts.

7 Claims, 4 Drawing Sheets

U.S. PATENT DOCUMENTS

| | | | |
|---|---|---|---|
| 3,786,767 | 1/1974 | Schwartz, Jr. et al. | 110/8 |
| 3,808,619 | 5/1974 | Vanderveer | 110/8 |
| 3,813,918 | 6/1974 | Moe | 73/15 |
| 3,822,111 | 7/1974 | Suzuki et al. | 23/273 |
| 3,855,494 | 12/1974 | Plagge | 313/184 |
| 3,880,143 | 4/1975 | Hart et al. | 126/343.5 |
| 3,890,825 | 6/1975 | Davis | 73/15 |
| 3,916,670 | 11/1975 | Davis et al. | 73/15 |
| 3,924,547 | 12/1975 | Werner | 110/8 |
| 3,936,659 | 2/1976 | Mainord | 219/413 |
| 4,009,605 | 3/1977 | Kober | 73/56 |
| 4,026,665 | 5/1977 | Mansfield et al. | 23/230 |
| 4,050,387 | 9/1977 | Luchsinger et al. | 110/8 |
| 4,057,438 | 11/1977 | Mainord | 134/2 |
| 4,106,329 | 8/1978 | Takahashi et al. | 73/15 |
| 4,142,403 | 3/1979 | Lohnes et al. | 73/76 |
| 4,165,633 | 8/1979 | Raisanen | 73/76 |
| 4,165,791 | 8/1979 | Smith | 177/212 |
| 4,248,315 | 2/1981 | Falinower | 177/50 |
| 4,269,592 | 5/1981 | Benton et al. | 432/19 |
| 4,270,898 | 6/1981 | Kelly | 432/19 |
| 4,291,775 | 9/1981 | Collins | 177/1 |
| 4,299,115 | 11/1981 | Athey et al. | 73/15 |
| 4,303,615 | 12/1981 | Jarmell et al. | 422/102 |
| 4,334,484 | 6/1982 | Payne et al. | 110/210 |
| 4,373,452 | 2/1983 | Van Dewoestine | 110/203 |
| 4,388,410 | 6/1983 | Arroyo et al. | 436/85 |
| 4,395,958 | 8/1983 | Caffyn et al. | 110/246 |
| 4,398,835 | 8/1983 | Athey et al. | 374/14 |
| 4,422,437 | 12/1983 | Hirschey | 126/77 |
| 4,449,921 | 5/1984 | Catallo | 432/8 |
| 4,460,332 | 7/1984 | Lawler | 432/72 |
| 4,462,963 | 7/1984 | O'Brien et al. | 422/78 |
| 4,485,284 | 11/1984 | Pakulis | 219/10.55 |
| 4,502,395 | 3/1985 | Barnett | 110/214 |
| 4,515,089 | 5/1985 | Ehrlichmann | 110/214 |
| 4,516,510 | 5/1985 | Basic, Sr. | 110/346 |
| 4,522,787 | 6/1985 | O'Brien et al. | 422/78 |
| 4,522,788 | 6/1985 | Sitek et al. | 422/78 |
| 4,531,462 | 7/1985 | Payne | 110/214 |
| 4,531,463 | 7/1985 | Kratz et al. | 110/214 |
| 4,550,669 | 11/1985 | Foresto | 110/245 |
| 4,554,132 | 11/1985 | Collins | 422/68 |
| 4,557,203 | 12/1985 | Mainord | 110/344 |
| 4,562,795 | 1/1986 | Kraus | 122/1 |
| 4,565,669 | 1/1986 | Collins et al. | 422/78 |
| 4,566,312 | 1/1986 | Collins et al. | 73/32 |
| 4,566,804 | 1/1986 | Collins et al. | 374/14 |
| 4,606,649 | 8/1986 | Mikhail | 374/10 |
| 4,606,650 | 8/1986 | Harris | 374/14 |
| 4,651,285 | 3/1987 | Collins et al. | 364/496 |
| 4,681,996 | 7/1987 | Collins et al. | 219/10.55 |
| 4,753,889 | 6/1988 | Collins | 436/23 |
| 4,789,332 | 12/1988 | Ramsey et al. | 432/59 |
| 4,793,292 | 12/1988 | Engstrom et al. | 122/4 |
| 4,817,745 | 4/1989 | Beshoory | 177/212 |
| 4,829,914 | 5/1989 | Boucher | 110/234 |
| 4,846,292 | 7/1989 | Narukawa | 177/50 |
| 4,862,813 | 9/1989 | Levin et al. | 110/216 |
| 4,870,910 | 10/1989 | Wright et al. | 110/214 |
| 4,874,950 | 10/1989 | Regimand | 250/390.04 |
| 4,878,839 | 11/1989 | Wunning | 432/72 |
| 4,913,069 | 4/1990 | Schultz et al. | 110/346 |
| 4,964,734 | 10/1990 | Yoshida et al. | 374/14 |
| 5,002,398 | 3/1991 | Musil | 366/7 |
| 5,002,399 | 3/1991 | Akinc et al. | 374/14 |
| 5,081,046 | 1/1992 | Schneider | 436/139 |
| 5,085,527 | 2/1992 | Gilbert | 374/14 |
| 5,127,827 | 7/1992 | Hoetzl et al. | 432/72 |
| 5,176,445 | 1/1993 | Mize | 366/7 |
| 5,179,933 | 1/1993 | McCrillis et al. | 126/77 |
| 5,200,155 | 4/1993 | Obermueller | 422/182 |
| 5,207,008 | 5/1993 | Wimberger et al. | 34/23 |
| 5,207,507 | 5/1993 | Kimoto et al. | 374/14 |
| 5,211,252 | 5/1993 | Henderson et al. | 177/25.14 |
| 5,215,377 | 6/1993 | Sugano | 374/14 |
| 5,251,564 | 10/1993 | Rim et al. | 110/344 |
| 5,279,971 | 1/1994 | Schneider | 436/139 |
| 5,318,754 | 6/1994 | Collins et al. | 422/109 |
| 5,322,052 | 6/1994 | McCrillis et al. | 126/503 |
| 5,359,946 | 11/1994 | Asoh et al. | 110/345 |
| 5,368,391 | 11/1994 | Crowe et al. | 374/10 |
| 5,465,690 | 11/1995 | Viel Lamare et al. | 122/4 |
| 5,558,029 | 9/1996 | Peake | 110/345 |

OTHER PUBLICATIONS

*NCAT Research Results in Environmentally Safe, Reliable Asphalt Content Test*, Focus (Spring1995), pp. 11–13.

Brochure, Strassentest Thermo–Analyse System.

Drüschner, *Erfahrungen mit der Thermoanalyse zur Bidenmittelgehaltsbestimmung von Asphalten*, Bitumen (Apr. 1993, pp. 158–162.

Vicelja, et al., *Thermogravimetric Analysis of Components and Modifiers of Hot–Mix Asphalt Concretes*, pp. 385–401.

Mailbag, *Getting hot over HMA pyrolysis*, Roads & Bridges (May, 1995), pp. 24–25.

Completed Registration Form for *New Burn–Off Procedure for Hot Mix Asphalt Concrete*.

Todres, et al., *Asphalt Content and Gradation of Some Canadian Hot–Mix Asphalt Concretes by Pyrolysis and By Conventional Techniques—A Comparative Study*, Proceedings of the Thirty–Ninth Annual Conference of Canadian Technical Asphalt Assocation, pp. 95–123.

Mainord, K. R., sparkle and shine, *Industrial Research* (Feb. 1978).

Gilson Asphalt Binder Ignition Furnace Model HM–378 Operating and Service Manual, Gilson Company, Inc.

Quickcool Asphalt Burn–Off System Model AP–900–4, ELE International.

Brochure, The new Thermoanalysis System from Strassentest; Rapid and exact determination of the binder content of asphalt, Baustoff–Prüfsysteme.

Jelenko Airguard Operating and Maintenance Instructions.

Standard Method for Proximate Analysis of Coal and Coke, *the American Society for Testing and Materials*, pp. 386–395.

Brochure, CEM Corporation Moisture/Solids Analyzer AVC–80.

Brochure, Fisher Sulfur Analyzer System: totally automated—with unsurpassed repeatability, economy, and operating ease.

European Search Report.

ADJUSTABLE APPARATUS FOR PYROLYSIS OF A COMPOSITE MATERIAL AND METHOD OF CALIBRATION THEREFOR

FIELD OF THE INVENTION

The present invention relates to apparatus and methods for testing materials, in particular, to apparatus and methods for processing and testing composite materials.

BACKGROUND OF THE INVENTION

When employing composite materials, for example, a bituminous mixture such as asphalt concrete, it is generally desirable to test the composition of the materials before installation to ensure that the installed material has desired properties of structural strength, durability and the like. For example, the "hot-mix" asphalt concrete used to pave roads, airport runways and the like desirably has a predetermined proportion of asphalt binder to aggregate and a predetermined gradation of aggregate size to help ensure that the material will have adequate and uniform application and wear properties. Accordingly, in the paving industry, determination of asphalt content and aggregate gradation in batches of asphalt concrete typically are critical quality assurance procedures.

Solvent extraction techniques have been widely used to determine asphalt content and aggregate gradation in asphalt concrete. According to these techniques, a sample of asphalt is weighed and then washed using a suitable solvent to remove the asphalt binder in the sample and leave a clean aggregate residue. The residue may then be weighed and compared to the prewashed weight of the sample to determine the asphalt content of the sample. The clean aggregate may also be sieved using a series of predetermined sieves to determine aggregate gradation.

Although solvent extraction techniques can effectively be used to determine asphalt content, they can have serious shortcomings. The solvent washing process typically is slow, a characteristic which undermines the utility of solvent extraction techniques in mass production environments in which rapid testing is desirable to ensure continuous quality control. The solvent washing process also tends to generate hazardous effluents which may pose a disposal problem, and traditionally employs chlorinated solvents traditionally which have been categorized as hazardous materials and accordingly have been banned in some governmental testing facilities. Alternative biodegradable solvents such as terpenes may be used, but tend to work in an even slower fashion than the chlorinated solvents they replace. Another alternative, the nuclear asphalt testing gauge, is an effective tool for measuring asphalt content but typically cannot perform aggregate gradation testing.

Promising alternative techniques which provide for both content and gradation analysis are pyrolysis techniques in which the asphalt binder in a sample of asphalt is burned off to leave an aggregate residue. Pyrolysis techniques are generally described in "*Historical Development of Asphalt Content Determination by the Ignition Method*," by Brown et al., and in "*Solvent-Free, Nuclear-Free Determination of Asphalt Content and Gradation of Hot-Mix Asphalt Concrete*, " by Todres et al., ASTM Journal of Testing and Evaluation, November 1994, 564–570. According to these techniques, a sample of asphalt concrete is placed in an oven or similar apparatus and heated to volatilize and combust the asphalt binder, thus separating the binder from the sample and leaving an aggregate residue. The temperature and other conditions at which pyrolysis occurs tend to be factors which strongly influence the accuracy of tests, as insufficient temperatures may not completely separate the binder and excessive temperatures can lead to aggregate loss and gradation changes induced by chemical changes in the aggregate and thermal shock. Several furnace-type apparatus have been developed for performing asphalt pyrolysis, including furnaces which incorporate an integral weighing scale in order to allow measurement of a sample of asphalt concrete during pyrolysis as described in, for example, U.S. Pat. No. 5,081,046 to Schneider et. al.

The asphalt binder in asphalt concrete typically includes a significant proportion of low-end hydrocarbons and impurities which are difficult to completely combust. Thus, one of the most vexing problems associated with asphalt pyrolysis is dealing with the volume of noxious, high particulate content smoke typically generated by the combustion of the asphalt binder. Although this noxious smoke may be exhausted out of the testing furnace using a fan or similar device, the smoke generated by heating of an asphalt sample generally is too noxious to directly exhaust into a laboratory exhaust system or similar environment, as direct discharge may produce an unacceptable level of pollution and may foul the exhaust system of the site in which the furnace is installed.

Several techniques for dealing with the smoke problem have been proposed. For example, an analyzing furnace previously developed by Troxler Electronic Laboratories, Inc. of Research Triangle Park, N.C., assignee of the present application, includes an afterburning chamber which receives and treats smoke and other byproducts of asphalt pyrolysis produced within a main furnace chamber connected thereto, exhausting cleaner gases from the afterburning chamber into a plenum and out of the furnace via a blower mounted on the plenum. Another furnace design employs filters designed to filter combustion products created by combustion of an asphalt sample within a combustion chamber of a furnace, as described in U.S. Pat. No. 5,558,029 to Peake.

Although these approaches may help combust smoke generated by pyrolysis of an asphalt sample, they may not provide optimal combustion conditions and thus, may render inaccurate and nonuniform results. Variations in exhaust characteristics at installation sites may lead to variation in combustion conditions. For example, a specimen of hot-mix asphalt may be divided into several samples which may be processed in different furnaces, even different furnaces at different testing sites. Variable combustion conditions in any of the furnaces may lead to inaccurate results, and nonuniform combustion conditions may result in nonuniform results among the furnaces. Moreover, nonoptimal combustion may lead to deleterious side effects such as poor emissions quality, formation of soot deposits in the furnace and exhaust system, and gaseous discharges into the testing site which may be harmful to personnel and equipment. Afterburners and filters may trap or burn some pollutants which otherwise might be discharged, but still may not produce the combustion and exhaust characteristics needed to reduce pollution and unwanted backflow emissions to an acceptable level.

SUMMARY OF THE INVENTION

In light of the foregoing, it is an object of the present invention to provide apparatus and methods for pyrolysis of a composite material including a combustible binder which produces more optimal combustion of the binder.

It is another object of the present invention to provide apparatus and methods for pyrolysis of a sample of composite material which can be tailored to particular installations.

It is another object of the present invention to provide apparatus and methods for pyrolysis of a composite material which produce more uniform and accurate results over a variety of installation sites.

These and other objects, features and advantages are provided according to the present invention by apparatus in which includes a combustion chamber and a heater configured to heat a sample of composite material within the combustion chamber to a temperature sufficient for pyrolysis of the binder in the sample, a blower which creates an airflow through an outlet of the chamber to remove airborne pyrolysis products from the combustion chamber, and an adjustable airflow regulator which adjustably controls the airflow. According to a preferred embodiment, the combustion chamber includes an oven chamber connected to an afterburning chamber through at least one passageway. The afterburning chamber preferably exhausts into a plenum defined by a plenum housing which substantially encloses the afterburning chamber. The plenum is in fluid communication with the afterburning chamber, with the blower being connected to an outlet of the plenum housing and the adjustable airflow regulator including an adjustable air intake for adjustably admitting ambient air into the plenum to adjust negative pressure created by the blower.

The present invention arises from the realization that more optimal combustion of the binder in a composite material sample may be achieved by providing a mechanism whereby the airflow though the apparatus used to burn the sample is adjustable to meet varying conditions, e.g., restriction and other characteristics of the exhaust system to which the apparatus is connected. The adjustable airflow regulation provided by the present invention can help optimize combustion and thus improve test accuracy and uniformity. In addition, by achieving more optimal combustion, the present invention can reduce undesirable discharges of noxious gases and particulates into the site's ventilation system and external environment, as well as undesirable backflow emissions into test areas.

In particular, according to the present invention, an apparatus for pyrolysis of a sample of a composite material containing a combustible binder includes a combustion chamber configured to receive a sample of the composite material. A heater is associated with the combustion chamber for heating the chamber to a temperature sufficient for pyrolysis of the binder. A blower is in fluid communication with the combustion chamber for creating an airflow through an outlet of the combustion chamber to remove airborne pyrolysis products from the combustion chamber. An adjustable airflow regulator is operable to adjustably control the airflow to provide a desired minimum residence time within the combustion chamber sufficient for complete pyrolysis of the airborne pyrolysis byproducts.

According to a preferred embodiment, the combustion chamber includes an oven chamber configured to receive a sample of the composite material for pyrolysis and an afterburning chamber located adjacent the oven chamber. At least one passageway provides fluid communication from the oven chamber to the afterburning chamber so that the airflow conveys airborne pyrolysis byproducts from the oven chamber into the afterburning chamber for further pyrolysis. The heater includes a first set of heating elements associated with the oven chamber for heating the oven chamber to a temperature sufficient for pyrolysis of the binder present in the sample, and a second set of heating elements associated with the afterburning chamber for heating the afterburning chamber to an elevated temperature sufficient for pyrolysis of any uncombusted airborne byproducts conveyed to the afterburning chamber. The blower is located downstream of the combustion chamber outlet for creating a negative pressure at the outlet to induce airflow into and through the oven chamber, through the at least one passageway, and then through the afterburning chamber. The adjustable airflow regulator includes means for adjusting the negative pressure at the outlet.

According to a preferred embodiment, the apparatus includes a plenum in fluid communication with the combustion chamber outlet. The blower is communicatively connected to an outlet of the plenum for exhausting air from the plenum. The adjustable airflow regulator includes an adjustable air intake for adjustably admitting ambient air into the plenum. The plenum may be defined by a plenum housing, and the adjustable air intake may include an opening in the plenum housing and means positioned on the plenum housing for adjustably restricting the opening to thereby control air intake into the plenum, such as an adjustable shutter. The means for adjusting the negative pressure at the outlet may also include a restrictable opening which adjustably controls negative pressure produced at the outlet of the combustion chamber and a variable speed control associated with the blower for adjustably controlling the blower output.

The oven chamber may include a floor, and may further include spaced apart rails positioned above the floor which are operable to support the sample of composite material within the oven chamber. A load cell may be positioned beneath the floor, external to the oven chamber, and a plurality of posts may pass through the floor and connect the rails to the load cell. A first temperature sensor may be positioned within the oven chamber and a second temperature sensor may be positioned within the afterburning chamber.

According to method aspects, a pyrolysis apparatus is calibrated by inducing an airflow through the combustion chamber, measuring the airflow, and adjusting the induced airflow to a predetermined value. Preferably, the airflow is induced by creating a negative pressure at the outlet of the combustion chamber of the apparatus, preferably by exhausting air from a plenum surrounding the outlet of the combustion chamber. The airflow may be adjusted by adjusting the negative pressure at the outlet, preferably by adjusting the size of a restricted opening which admits air into the plenum. According to a preferred method aspect, calibration is performed by inducing an airflow through the combustion chamber, heating the combustion chamber, measuring the temperature change in the combustion chamber, and adjusting the induced airflow to achieve a predetermined temperature change per unit time.

BRIEF DESCRIPTION OF THE DRAWINGS

Some of the objects and advantages of the present invention having been stated, others will be more fully understood from the detailed description that follows and by reference to the accompanying drawings in which.

DETAILED DESCRIPTION OF THE PREFERRED EMBODIMENT

Figure 1:
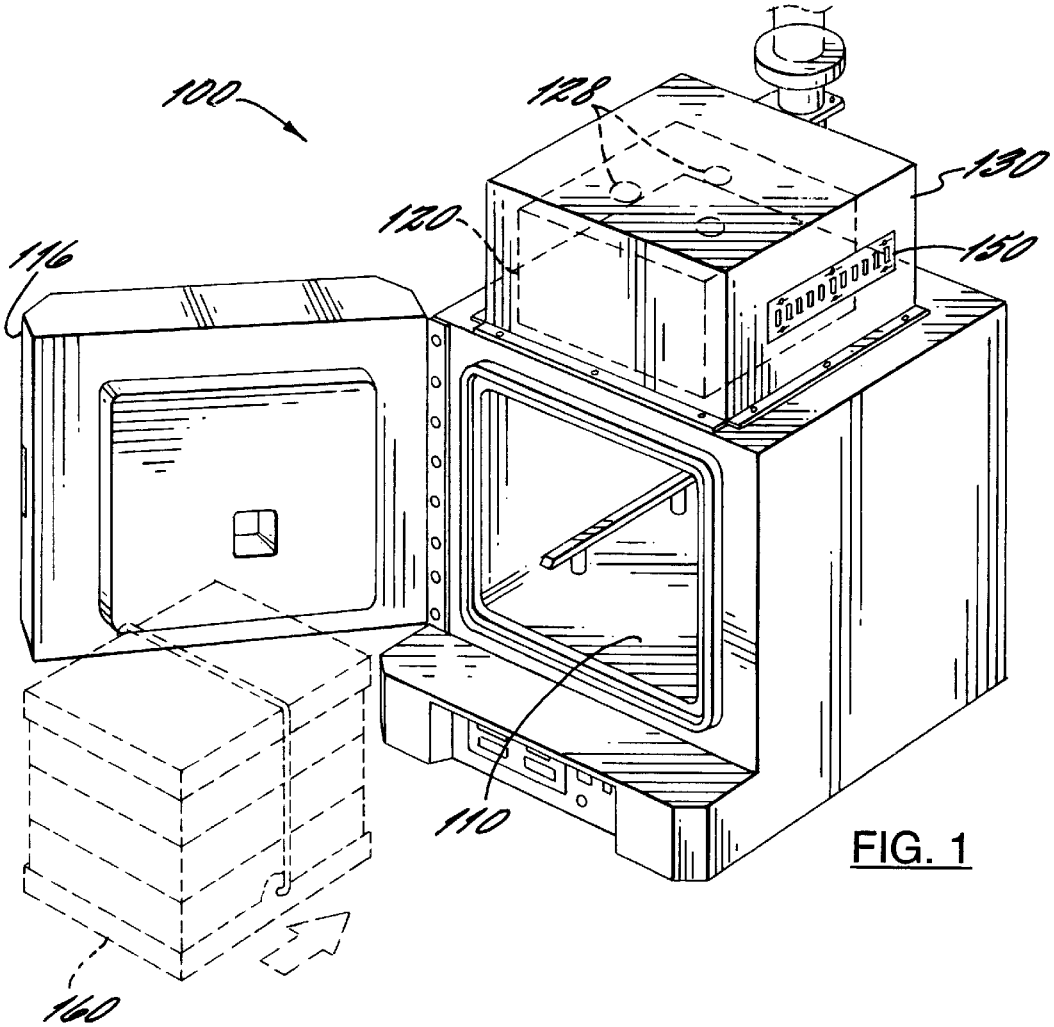
FIG. 1 is a perspective view illustrating a preferred embodiment of an apparatus for analyzing composite materials according to the present invention.

The present invention now will be described more fully hereinafter with reference to the accompanying drawings, in which a specific embodiment of the invention is shown. This invention may, however, be embodied in many different forms and should not be construed as limited to the embodiments set forth herein; rather, this illustrated embodiment is provided so that this disclosure will be thorough and complete, and will fully convey the scope of the invention to those skilled in the art. In the drawings, the thickness of layers and regions are exaggerated for clarity, and like numbers refer to like elements throughout.

FIGS. 1–4 illustrate a preferred embodiment of an apparatus 100 for analyzing composite materials, e.g., asphalt concrete, roofing materials and the like, according to the present invention. The apparatus 100 includes an oven chamber 110 which is in fluid communication with an afterburning chamber 120 mounted above the oven chamber 110. A housing 130 substantially encloses the afterburning chamber 120, defining a plenum 131 which is in fluid communication with an outlet of the afterburning chamber 120, here shown as a plurality of passageways 128 connecting the afterburning chamber 120 and the plenum 131. A blower 140 is mounted on the housing 130 for exhausting air from the plenum 131 through an outlet opening 132 providing in a wall of the housing 130. An adjustable airflow regulator is also provided, here illustrated as an adjustable air intake 150 on a wall of the plenum housing 130 which allows control of the rate at which ambient air is drawn into the plenum 131 by the blower 140. The oven chamber 110 also preferably includes a door 116 which provides access to the oven chamber 110 to allow placement of a sample tray 160 within the oven chamber 110.

The plenum outlet opening 132 may be connected to a variety of external exhaust systems to discharge gases and other products produced by pyrolysis of a sample of composite material. As those skilled in the art will appreciate, these exhaust systems may include pipes or ducts directly connected to the plenum outlet opening 132 which directly carry pyrolysis products directly into the atmosphere or into additional pollution treatment devices, or laboratory hoods or similar ventilation apparatus to which the outlet 132 may be placed adjacent, which establish a localized air flow to carry pyrolysis products from the outlet 132 into an exhaust system. As those skilled in the art will appreciate, these exhaust configurations may present a variety of airflow conditions which may affect the flow of air and pyrolysis products through and out of the apparatus 100. The adjustable air flow regulator intake 150 can compensate for these variations by allowing the negative pressure induced by the blower 140 to be varied to fit the exhaust configuration characteristics.

Figure 3:
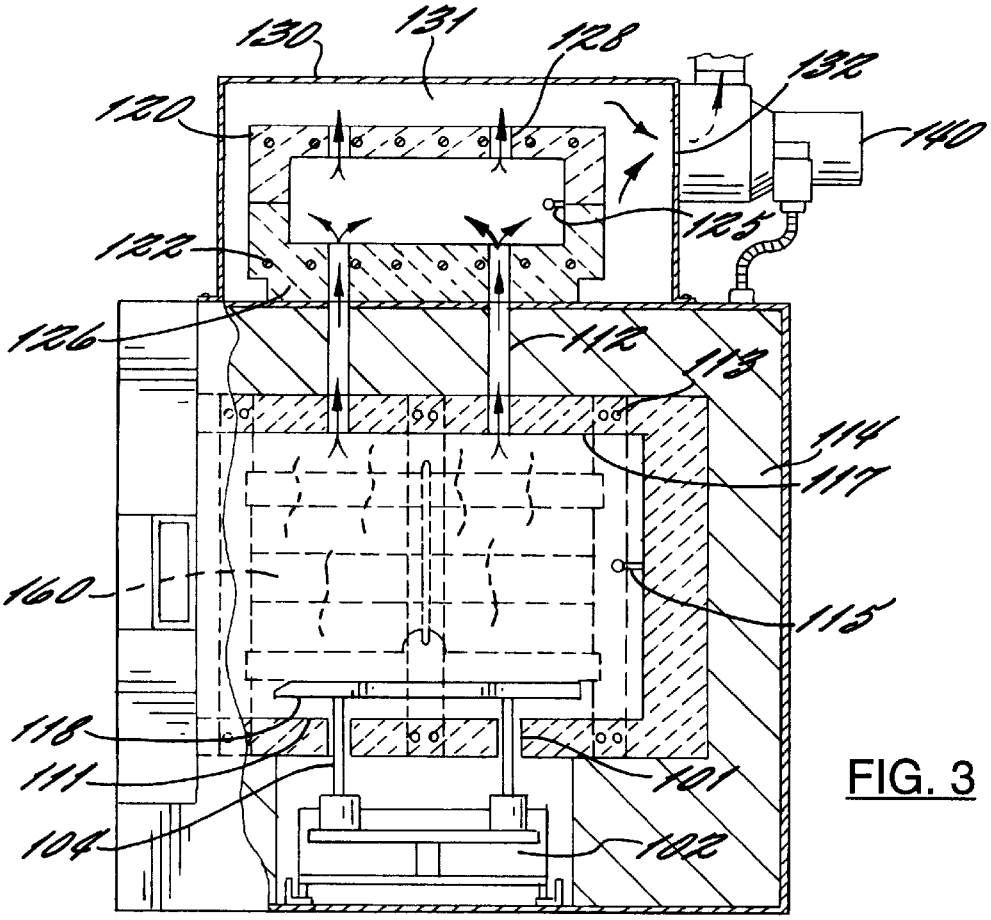
FIG. 3 is a cross-sectional view of the apparatus of FIG. 1 along the line A—A of FIG. 2.

Referring to FIG. 3, The oven chamber 110 preferably is lined by a refractory material lining 114, while the afterburning chamber 120 similarly has a refractory material lining 126. The refractory linings 114, 126 form an insulating wall which substantially separates the oven chamber 110 and the afterburning chamber 120, with one or more bores 112 through a top wall 117 of the oven chamber 110 which provide passageways for allowing gases and other byproducts produced by heating a sample within the oven chamber 110 to be conveyed into the afterburning chamber 120. FIG. 3 also illustrates one of a pair of spaced apart rails 118 which are positioned above a floor 111 of the oven chamber 110 and are configured to support a sample tray 160 placed within the oven chamber 110. Preferably, the spaced apart rails 118 are supported atop a plurality of posts 104 which pass through openings 101 in the floor 111 of the oven chamber 110, with the holes 101 preferably having a larger diameter than the posts 104 to allow air to pass around the posts 104. The posts 104 are in turn supported by a load cell 102 beneath the floor 111 of the oven chamber 110. In this manner, a sample placed within the oven chamber 110 may be continuously weighed during processing.

The oven chamber 110 preferably includes a door 116 which provides access to the oven chamber 110 to allow placement of a sample tray 160 within the oven chamber 110. A heater, here shown as a plurality of heating elements 113 embedded in the refractory material lining 114 surrounding the oven chamber 110, heats a sample of composite material placed within the oven chamber 110 to a temperature sufficient to separate a binder portion from the sample. As indicated by the arrows in FIG. 3, the blower 140 induces an airflow within the oven, drawing ambient air through the holes 101 in the floor 111 of the oven chamber 110. The airflow passes through the sample tray 160 and conveys products of pyrolysis of the binder in the sample upwards through the passageways 112 and into the afterburning chamber 120.

Figure 2:
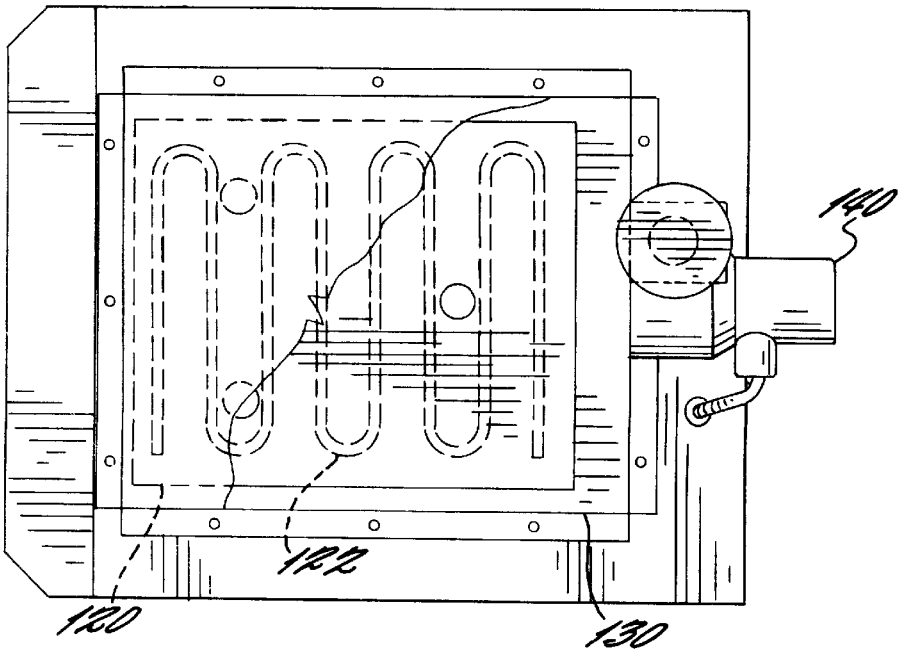
FIG. 2 is a top view of the apparatus of FIG. 1.

As illustrated in FIGS. 2 and 3, the afterburning chamber 120 preferably includes a heater, here illustrated as a pair of electrical resistance heating elements 122 embedded in top and bottom walls of the afterburning chamber 120, respectively, which provide heat within the afterburning chamber 120 sufficient to combust the pyrolysis products received from the oven chamber 110. The airflow then carries gases produced by combustion of pyrolysis products in the afterburning chamber 120 into the plenum 131 and out of the plenum outlet opening 132.

Temperatures produced within the oven chamber 110 preferably are measured using a temperature sensor 115, e.g., a thermocouple, thermistor or similar temperature sensing device, mounted within the oven chamber 110, while temperatures within the afterburning chamber 120 preferably are measured by another temperature sensor 125 mounted within the afterburning chamber 120. The temperature sensors 115, 125 preferably are used as transducers to control the temperature of the heating elements 113, 122, and may as well be used for airflow calibration, as described below. An addition temperature sensor may be positioned near the load cell 102 to monitor temperatures in this area to prevent damage to the load cell 102, and to measure temperatures for airflow calibration, calibration of weight measurements by the load cell 102, and the like.

Figure 4:
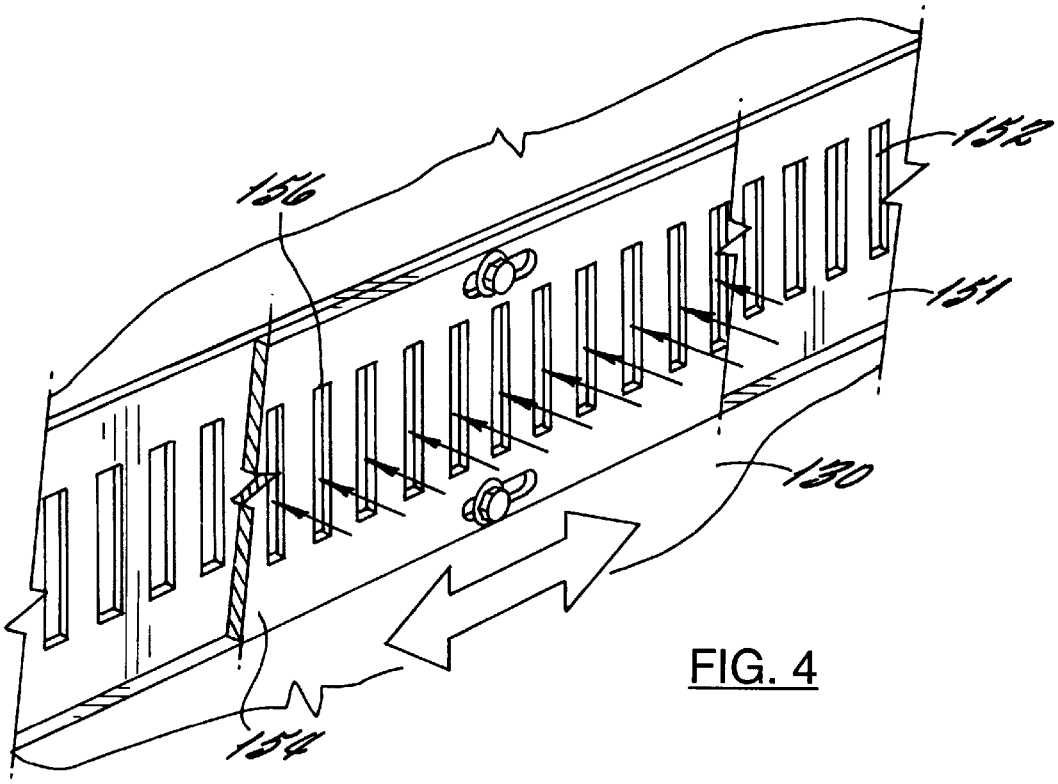
FIG. 4 is a detailed view showing the adjustable air intake of FIG. 1.

FIG. 4 provides a detailed illustration of a preferred embodiment of an adjustable airflow regulator, in particular an adjustable air intake 150 on the plenum housing 130 which is operable to adjustably control the airflow induced by the blower 140 through the oven chamber 110 and the afterburning chamber 120 by adjusting the amount of ambient air taken into the plenum 131. According to the illustrated embodiment, the adjustable air intake 150 includes a shutter comprising a plurality of openings 152 formed in a wall 151 of the plenum housing 130, and a plate 154 including a plurality of openings 156 which is slidably mounted on the plenum housing wall 151 such that the relative alignment of the openings 152 in the plenum wall 151 and the openings 156 in the plate 154 may be adjusted to control the intake of outside air into the plenum 130. By adjusting the air intake into the plenum 131, negative pressure in the plenum 131 can be adjusted, thus allowing calibration of the airflow through the oven chamber 110 and the afterburning chamber 120, as described more fully below.

Those skilled in the art will appreciate that other embodiments of an adjustable airflow regulator may be used with the present invention. For example, instead of the shutter mechanism illustrated in FIG. 4, a louver-type mechanism may be used to control air intake into the plenum 130. The blower 140 preferably includes an electrically-powered fan which may be controlled, for example, by a variable speed control which varies the speed of the fan to vary the output of the blower 140. The adjustable airflow regulator may also include, for example, a restrictable opening such as a mechanically or electro mechanically actuated damper or similar device installed at the plenum outlet opening 132, in portions of the exhaust system connected thereto, or at the holes 101 in the floor 111 of the oven chamber 110, which may be adjusted to vary the negative pressure produced by the blower 140 and thus vary the rate at which gases are exhausted from the plenum 131. Those skilled in the art will appreciate that the adjustable airflow regulator of the present invention may include these and other airflow control devices, alone or in combination.

As described above, the present invention arises from the realization that because of the potential variations in exhaust configurations at sites at which the pyrolysis apparatus is installed, it is generally desirable to be able to calibrate the airflow through the apparatus at the installation site of the apparatus rather than at the facility where the apparatus is fabricated, so that more optimal combustion is achieved to ensure accurate and uniform test results and to reduce unwanted pollution and fouling of exhaust components. Towards this end, FIGS. 5 and 6 illustrate operations for calibrating a pyrolysis apparatus according to the present invention.

Figure 5:
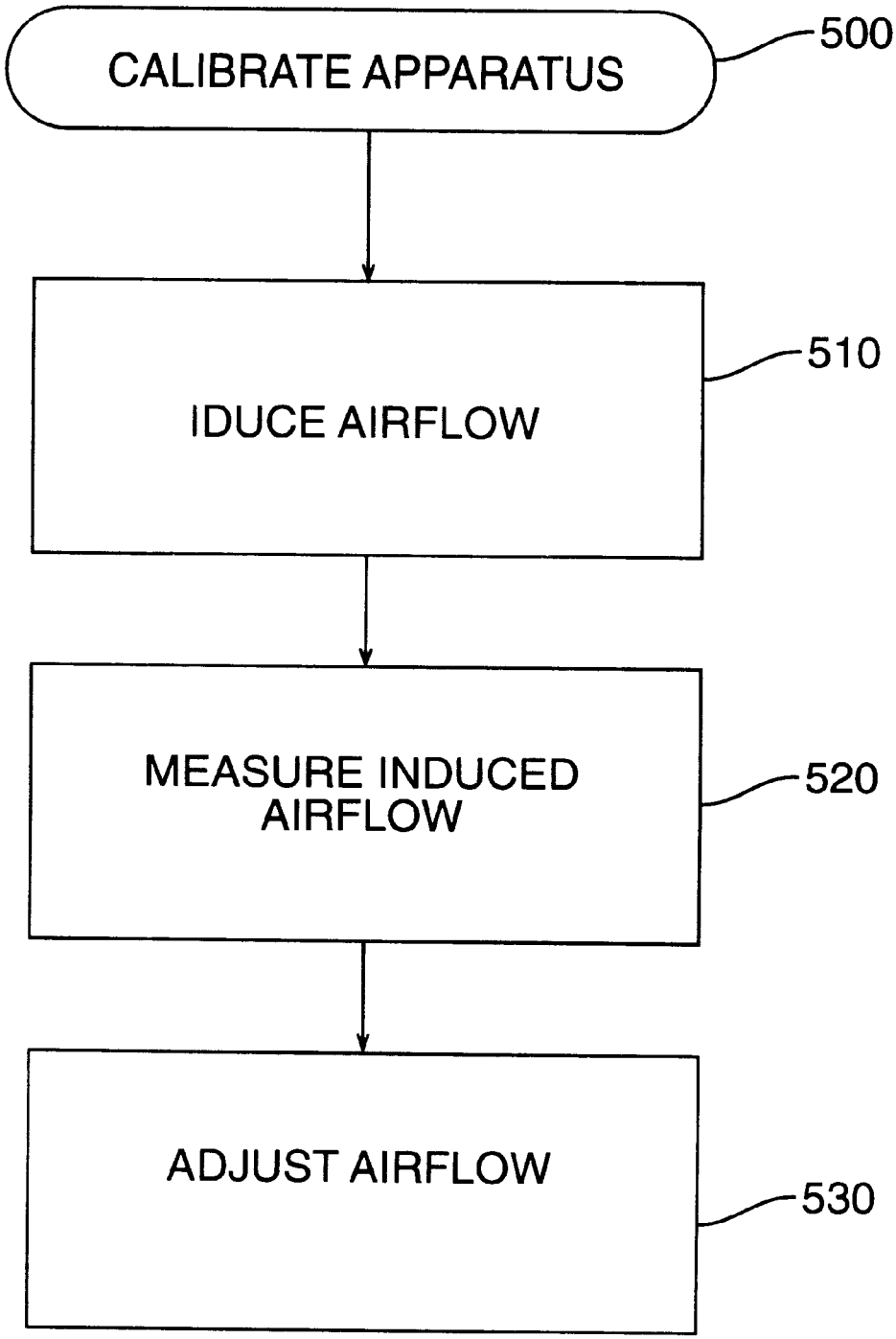
FIGS. 5–6 are a flowchart illustrations of calibration operations according to the present invention.

Referring to FIG. 5, operations (Block 500) for calibrating airflow through a pyrolysis apparatus such as the apparatus 100 of FIGS. 1–4, including inducing an airflow within the apparatus, preferably using a blower on the apparatus (Block 510). The induced airflow is measured by a airflow transducer (Block 520), and the airflow is adjusted to within a predetermined range (Block 530). According to a preferred method aspect (Block 600) illustrated in FIG. 6, a sample of composite material is placed within the combustion chamber of the apparatus (Block 610). An airflow is induced (Block 620) and the combustion chamber is heated (Block 630), preferably to a temperature sufficient to pyrolyze a binder portion of the sample. Preferably concurrent with heating of the combustion chamber, a time interval required to produce a predetermined temperature change within the combustion chamber is determined (Block 640), as measured by a temperature sensor in fluid communication with the combustion chamber, for example, the temperature sensor 115 illustrated in FIG. 3. If the predetermined temperature change per unit time is achieved (Block 650), calibration is complete (Block 680). If not, the airflow is adjusted (Block 660), the combustion chamber allowed to cool (Block 670), and the combustion chamber reheated (Block 630). The time interval required to produce the predetermined temperature change is again determined (Block 640), and the airflow readjusted (Block 660), if necessary. The determining (Block 640), adjusting (Block 660), cooling (Block 670) and heating (Block 630) operations may be repeated until the predetermined temperature change per unit time is achieved.

Figure 6:
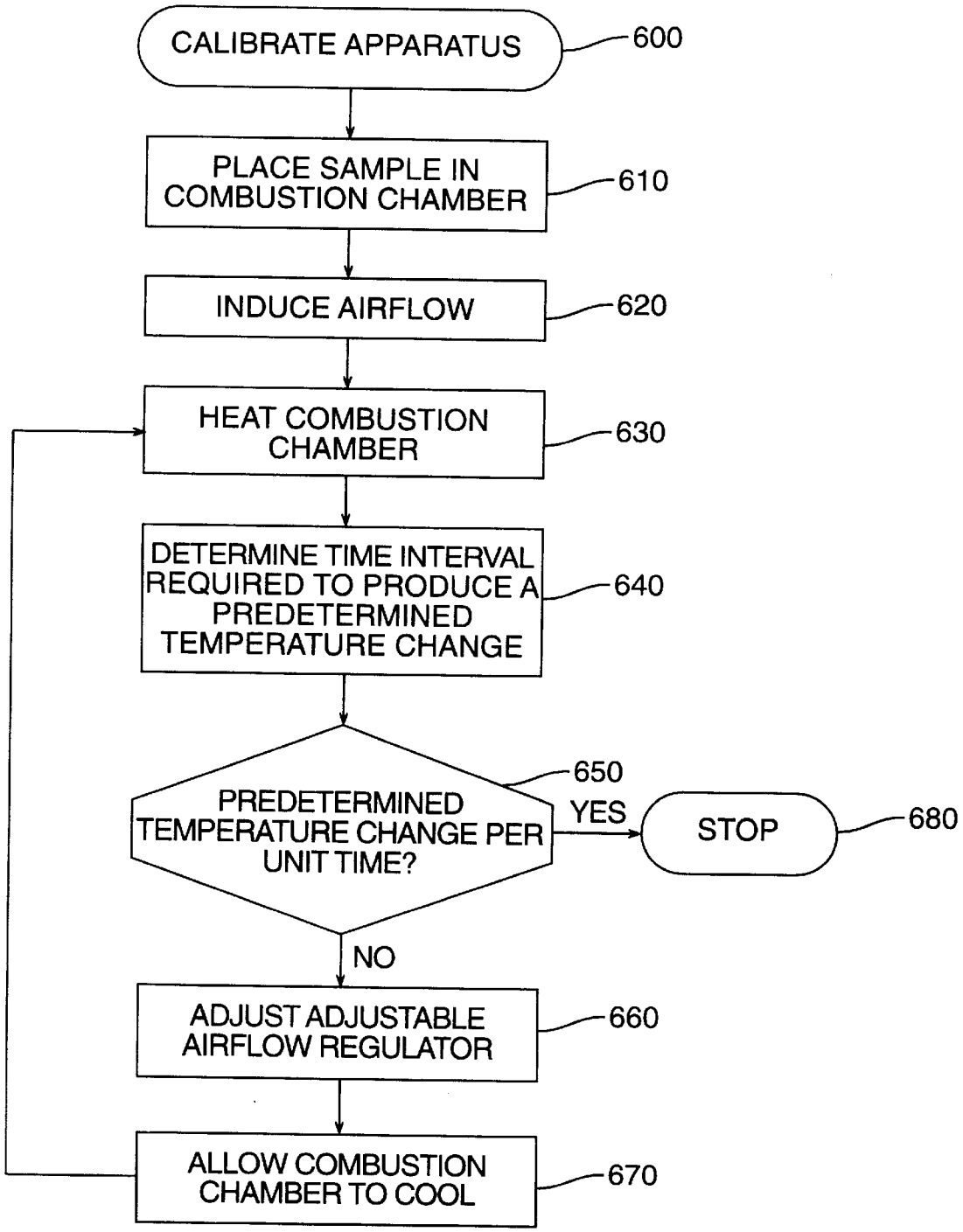

Those skilled in the art will appreciate that although the operations of FIG. 6 are preferred, other operations and apparatus may be used to perform the airflow calibration of the present invention. For example, the determination of the temperature changes may be performed without having a sample within the oven. Instead of using a temperature sensor, a flow meter or similar device may be employed to measure the airflow induced within the apparatus, with or without heating of the combustion chamber or a sample therein. Those skilled in the art will also appreciate that the transducer employed may be placed in a variety of locations within the apparatus, for example, within the oven chamber 110 and/or the afterburning chamber 120 of the apparatus described in FIGS. 1–4.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. An apparatus for pyrolysis of a sample of a composite material containing a combustible binder, comprising:

an oven housing defining an oven chamber configured to receive a sample of the composite material, said oven housing including a floor and an opposing top wall and a door for providing access to the oven chamber;

an afterburner housing defining an afterburning chamber; said afterburner housing being mounted on said top wall of said oven housing, and said afterburner housing having an outlet;

at least one bore extending through said top wall of said oven housing and providing fluid communication between said oven chamber and said afterburning chamber;

a blower in fluid communication with said afterburner housing outlet for exhausting air from said afterburner housing outlet to create an airflow into and through said oven chamber, through said bores, and through said afterburning chamber remove airborne pyrolysis products;

a heater associated with said oven housing for heating the oven chamber to a temperature sufficient for pyrolysis of the binder present in the sample;

a heater associated with said afterburner housing for heating the afterburning chamber to a temperature sufficient for pyrolysis of airborne pyrolysis byproducts conveyed from said oven chamber to said afterburning chamber; and an adjustable airflow regulator operable to adjustably control the amount of air exhausted from said afterburner housing outlet to provide a desired minimum residence time within said combustion chamber sufficient for complete pyrolysis of the airborne pyrolysis byproducts.

2. An apparatus according to claim 1, including a plenum housing surrounding said afterburner housing and defining a plenum, said blower being mounted to said plenum housing for exhausting air from said plenum to create a negative pressure at said afterburner housing outlet to induce airflow into and through said oven chamber, through said at least one passageway, and then through said afterburning chamber, and wherein said adjustable airflow regulator comprises means for adjusting the negative pressure at said outlet.

3. An apparatus according to claim 2, wherein said means for adjusting the negative pressure at said outlet comprises an adjustable air intake for adjustably admitting ambient air into said plenum.

4. An apparatus according to claim 1, further comprising an airflow transducer for measuring said airflow.

5. An apparatus according to claim 1, further comprising a first temperature sensor positioned within said oven chamber and a second temperature sensor positioned within said afterburning chamber, and a third temperature sensor positioned external to said oven chamber, adjacent said oven chamber floor.

6. An apparatus according to claim 1, wherein said oven chamber further comprises:

spaced apart rails positioned above said floor, said spaced apart rails being operable to support the sample of composite material within said oven chamber;

a load cell positioned beneath said floor external to said oven chamber; and a plurality of posts passing through said floor and connecting said rails to said load cell.

7. An apparatus for pyrolysis of a sample of a composite material containing a combustible binder comprising:

an oven housing defining an oven chamber configured to receive a sample of the composite material, said oven housing including a floor and an opposing top wall and a door for providing access to the oven chamber;

an afterburner housing defining an afterburning chamber; said afterburner housing being mounted on said top wall of said oven housing, and said afterburner housing having an outlet;

at least one passageway extending through the top wall of the oven housing;

a blower in fluid communication with said afterburner housing outlet for exhausting air from said afterburner housing outlet to create an airflow into and through said oven chamber, through said passageway, and through said afterburning chamber remove airborne pyrolysis products;

a heater associated with said oven housing for heating the oven chamber to a temperature sufficient for pyrolysis of the binder present in the sample;

a heater associated with said afterburner housing for heating the afterburning chamber to a temperature sufficient for pyrolysis of airborne pyrolysis byproducts conveyed from said oven chamber to said afterburning chamber; and an adjustable airflow regulator operable to adjustably control the amount of air exhausted from said afterburner housing outlet to provide a desired minimum residence time within said combustion chamber sufficient for complete pyrolysis of the airborne pyrolysis byproducts.

* * * * *